US009503816B2

(12) United States Patent
Iseki et al.

(10) Patent No.: US 9,503,816 B2
(45) Date of Patent: Nov. 22, 2016

(54) SURROUND SIGNAL GENERATING DEVICE, SURROUND SIGNAL GENERATING METHOD AND SURROUND SIGNAL GENERATING PROGRAM

(75) Inventors: Akihiro Iseki, Kanagawa (JP); Yoshiki Ohta, Kanagawa (JP);
(Continued)

(73) Assignee: PIONEER CORPORATION, Kanagawa (JP)

( * ) Notice: Subject to any disclaimer, the term of this patent is extended or adjusted under 35 U.S.C. 154(b) by 274 days.

(21) Appl. No.: 13/822,855

(22) PCT Filed: Sep. 14, 2010

(86) PCT No.: PCT/JP2010/065812
§ 371 (c)(1),
(2), (4) Date: Mar. 13, 2013

(87) PCT Pub. No.: WO2012/035612
PCT Pub. Date: Mar. 22, 2012

(65) Prior Publication Data
US 2013/0170648 A1 Jul. 4, 2013

(51) Int. Cl.
*H04S 5/02* (2006.01)
*H04R 3/12* (2006.01)
(Continued)

(52) U.S. Cl.
CPC . *H04R 3/12* (2013.01); *H04S 5/02* (2013.01); *H04S 7/30* (2013.01); *H04S 5/005* (2013.01)

(58) Field of Classification Search
CPC ..... H04S 3/00; H04S 5/00; H04S 5/02; H04S 1/00; H04S 7/30; H04S 2420/01; H04R 3/12
(Continued)

(56) References Cited

U.S. PATENT DOCUMENTS 8,160,259 B2 * 4/2012 Noguchi et al. ..... 381/17
8,195,316 B2 * 6/2012 Takashima ..... 700/94
(Continued)

FOREIGN PATENT DOCUMENTS

JP 2003-333698 11/2003
JP 2006-217210 8/2006
(Continued)

OTHER PUBLICATIONS

International Search Report dated Oct. 12, 2010, in corresponding PCT application.

*Primary Examiner* — Vivian Chin
*Assistant Examiner* — Jason R Kurr
(74) *Attorney, Agent, or Firm* — Young & Thompson

(57) ABSTRACT

A surround signal generating device includes: a surround signal generating unit which subtracts a sound signal obtained by multiplying a first gain by an inputted sound signal of a right channel from an inputted sound signal of a left channel so as to generate a surround signal of the left channel, and which subtracts a sound signal obtained by multiplying a second gain by the inputted sound signal of the left channel from the inputted sound signal of the right channel so as to generate a surround signal of the right channel; and a gain setting unit which sets the first gain and the second gain so that a correlation between the surround signal of the left channel and the surround signal of the right channel which are generated by the surround signal generating unit realizes a correlation between surround signals of an actual content having a surround sound.

19 Claims, 7 Drawing Sheets

(75) Inventors: Hiroyuki Ishihara, Kanagawa (JP);
Yoshitomo Imanishi, Kanagawa (JP);
Shinichi Kikuchi, Kanagawa (JP)

(51) Int. Cl.
*H04S 7/00* (2006.01)
*H04S 5/00* (2006.01)

(58) Field of Classification Search
USPC ..... 381/1, 17–23, 61, 63
See application file for complete search history.

(56) References Cited

U.S. PATENT DOCUMENTS

| | | | | |
|---|---|---|---|---|
| 8,300,835 | B2 * | 10/2012 | Ohta | H04S 5/02 381/58 |
| 2005/0031128 | A1 * | 2/2005 | Tomita | H04R 5/02 381/18 |
| 2008/0019533 | A1 | 1/2008 | Noguchi et al. | |
| 2008/0226085 | A1 * | 9/2008 | Takashima | 381/18 |
| 2009/0279706 | A1 | 11/2009 | Takashima | |

FOREIGN PATENT DOCUMENTS

| | | |
|---|---|---|
| JP | 2008-028693 | 2/2008 |
| JP | 2009-159020 | 7/2009 |
| JP | 2009-272849 | 11/2009 |

* cited by examiner

SURROUND SIGNAL GENERATING DEVICE, SURROUND SIGNAL GENERATING METHOD AND SURROUND SIGNAL GENERATING PROGRAM

TECHNICAL FIELD

The present invention relates to a technical field for generating surround signals of multiple channels from sound signals of two channels.

BACKGROUND TECHNIQUE

This kind of technique is proposed in Patent Reference-1, for example. In Patent Reference-1, as for an audio device which generates surround signals of multiple channels based on audio signals (stereo signals) of two channels corresponding to input signals, there is proposed a technique for calculating a difference between an output from an uncorrelated filter and an input signal of other channel so as to output the difference as the surround signals. Namely, the technique described in Patent Reference-1 generates a high correlation signal from the audio signals of the two channels, and makes the surround signals uncorrelated by calculating the difference.

In the specification, a signal which is reproduced from a lateral side to a rear side of a listener, or a signal which should be localized from the lateral side to the rear side of the listener is referred to as "surround signal". Additionally, a channel of the surround signal is referred to as "surround channel".

PRIOR ART REFERENCE

Patent Reference

Patent Reference-1: Japanese Patent Application Laid-open under No. 2003-333698

DISCLOSURE OF INVENTION

Problem to be Solved by the Invention

By the way, the inventors of the present invention discover that a correlation between the surround channels tends to be a positive correlation by analyzing actual contents having a surround sound. However, in the technique described in Patent Reference-1, since the correlation between the generated surround channels is from an inverse correlation to a decorrelation, the above correlation between the surround channels of the actual contents cannot appropriately be realized.

The present invention has been achieved in order to solve the above problem. It is an object of the present invention to provide a surround signal generating device, a surround signal generating method and a surround signal generating program capable of generating surround signals which can realize a correlation between surround channels of an actual content.

Means for Solving the Problem

In the invention according to claim 1, a surround signal generating device to which two-channel sound signals having a left channel and a right channel are inputted, and which generates surround signals of a left channel and a right channel at least, includes: a surround signal generating unit which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting unit which sets the first gain and the second gain so that a correlation between the surround signal of the left channel and the surround signal of the right channel which are generated by the surround signal generating unit realizes a correlation between surround signals of an actual content having a surround sound.

In the invention according to claim 13, a surround signal generating method to which two-channel sound signals having a left channel and a right channel are inputted, and which generates surround signals of a left channel and a right channel at least, includes: a surround signal generating process which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting process which sets the first gain and the second gain so that a correlation between the surround signal of the left channel and the surround signal of the right channel which are generated by the surround signal generating process realizes a correlation between surround signals of an actual content having a surround sound.

In the invention according to claim 14, a surround signal generating program executed by a computer, to which two-channel sound signals having a left channel and a right channel are inputted, and which generates surround signals of a left channel and a right channel at least, making the computer function as: a surround signal generating unit which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting unit which sets the first gain and the second gain so that a correlation between the surround signal of the left channel and the surround signal of the right channel which are generated by the surround signal generating unit realizes a correlation between surround signals of an actual content having a surround sound.

DETAILED DESCRIPTION OF THE PREFERRED EMBODIMENTS

Figure 1:
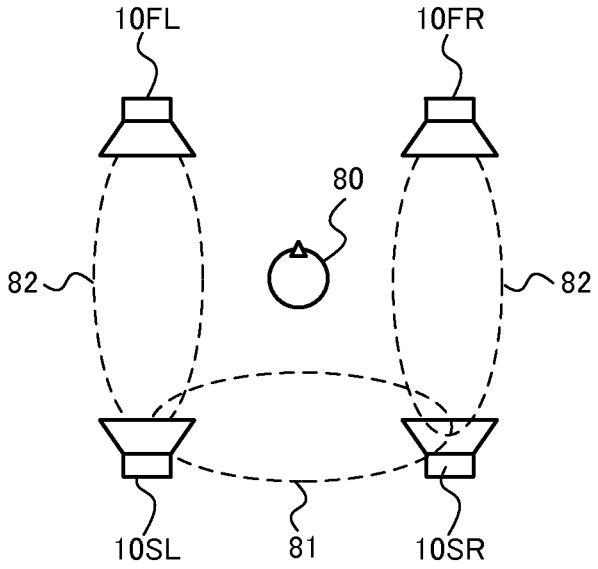
FIG. 1 is a diagram showing an example of a four-channel system.

According to one aspect of the present invention, there is provided a surround signal generating device to which two-channel sound signals having a left channel and a right channel are inputted, and which generates surround signals of a left channel and a right channel at least, including: a surround signal generating unit which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting unit which sets the first gain and the second gain so that a correlation between the surround signal of the left channel and the surround signal of the right channel which are generated by the surround signal generating unit realizes a correlation between surround signals of an actual content having a surround sound.

The above surround signal generating device is preferably used for generating surround signals of multiple channels from sound signals of two channels. The surround signal generating unit subtracts the sound signal obtained by multiplying the first gain by the inputted sound signal of the right channel from the inputted sound signal of the left channel, so as to generate the surround signal of the left channel. Additionally, the surround signal generating unit subtracts the sound signal obtained by multiplying the second gain by the inputted sound signal of the left channel from the inputted sound signal of the right channel, so as to generate the surround signal of the right channel The gain setting unit sets the first gain and the second gain so that the correlation between the surround signals of the left and right channels which are generated by the surround signal generating unit realizes the correlation between the surround signals of the actual content having the surround sound. By using the above first and second gains, it becomes possible to appropriately generate the surround signals which can realize the correlation between the surround signals of the actual content.

In a manner of the above surround signal generating device, the gain setting unit sets the first gain and the second gain so that the correlation between the surround signal of the left channel and the surround signal of the right channel which are generated by the surround signal generating unit is within a range of correlations between surround signals which are calculated from multiple actual contents. Therefore, it becomes possible to appropriately realize the correlation between the surround signals of the actual content.

In another manner of the above surround signal generating device, the gain setting unit sets the first gain and the second gain so that the correlation between the surround signal of the left channel and the surround signal of the right channel which are generated by the surround signal generating unit becomes an average value of correlations between surround signals which are calculated from multiple actual contents. Therefore, it becomes possible to more appropriately realize the correlation between the surround signals of the actual content.

In another manner of the above surround signal generating device, the gain setting unit sets the first gain and the second gain so that the correlation between the surround signal of the left channel and the surround signal of the right channel which are generated by the surround signal generating unit becomes a positive correlation. In the manner, since the correlation between the surround signals of the actual content is the positive correlation as mentioned above, the gain setting unit can set the first and second gains so that the correlation between the surround signals becomes at least the positive correlation.

In a preferred example of the above surround signal generating device, the gain setting unit sets the first gain and the second gain to a same value. Therefore, it is possible to easily determine the first and second gains.

In another preferred example of the above surround signal generating device, the gain setting unit sets the first gain and the second gain to different values. Therefore, even if the first and second gains cannot be set to the same value due to a restriction imposed on the first gain and/or the second gain, for example, it is possible to appropriately determine the first and second gains.

In another manner, the surround signal generating device generates sound signals of a front channel and sound signals of a rear channel, and uses the surround signals as the sound signals of the rear channel. The surround signal generating device further includes a delay value setting unit which sets a delay value indicating such a degree that the sound signals of the rear channel is outputted behind the sound signals of the front channel. The surround signal generating unit executes a process for delaying the surround signal of the left channel generated by using the first gain and the surround signal of the right channel generated by using the second gain with respect to the sound signals of the front channel, by the delay value set by the delay value setting unit. The delay value setting unit sets the delay value so that a correlation between the sound signals of the front channel and the sound signals of the rear channel including the surround signals of the left and right channels which are delayed by the surround signal generating unit realizes a correlation between sound signals of front and rear channels of the actual content.

In the above manner, the surround signal generating device sets not only the above first and second gains but also the delay value indicating such a degree that the sound signals of the rear channel is outputted behind the sound signals of the front channel, so as to generate the surround signals. Concretely, the surround signal generating device sets the delay value after setting the first and second gains in order to realize not only the correlation between the surround signals of the actual content but also the correlation between the rear channel and the front channel of the actual content. Therefore, it becomes possible to appropriately generate the surround signals which can realize both the correlation between the surround signals of the actual content and the correlation between the rear channel and the front channel of the actual content.

In another manner of the above surround signal generating device, the delay value setting unit sets the delay value so that the correlation between the sound signals of the front channel and the sound signals of the rear channel delayed by the surround signal generating unit is within a range of correlations between sound signals of front and rear channels, which are calculated from multiple actual contents. Therefore, it becomes possible to appropriately realize the correlation between the rear channel and the front channel of the actual content.

In another manner of the above surround signal generating device, the delay value setting unit sets the delay value so that the correlation between the sound signals of the front channel and the sound signals of the rear channel delayed by the surround signal generating unit becomes an average value of correlations between sound signals of front and rear channels, which are calculated from multiple actual contents. Therefore, it becomes possible to more appropriately realize the correlation between the rear channel and the front channel of the actual content.

In another manner of the above surround signal generating device, whenever a content for which the surround signals are generated changes, the gain setting unit sets the first gain and the second gain, and the delay value setting unit sets the delay value. This is because, when the content changes, the correlation between the surround signals and the correlation between the rear channel and the front channel of the actual content also change. According to the above surround signal generating device, it is possible to appropriately set the first and second gains and the delay value in accordance with the reproduced content.

In another manner, the above surround signal generating device further includes a storage unit which stores the first gain, the second gain and the delay value which are preliminarily calculated. The gain setting unit reads the first gain and the second gain from the storage unit, and sets the gains. The delay value setting unit reads the delay value from the storage unit, and sets the value. Therefore, it is possible to easily set the first and second gains and the delay value without executing a process for calculating the first and second gains and the delay value.

In a preferred example of the above surround signal generating device, the storage unit stores the first gain, the second gain and the delay value which are associated with each genre of contents, and the gain setting unit reads the first gain and the second gain in accordance with a genre of a content for which the surround signals are generated, from the storage unit, and the delay value setting unit reads the delay value in accordance with the genre of the content for which the surround signals are generated, from the storage unit. Therefore, it is possible to appropriately set the first and second gains and the delay value in accordance with the genre of the content.

According to another aspect of the present invention, there is provided a surround signal generating method to which two-channel sound signals having a left channel and a right channel are inputted, and which generates surround signals of a left channel and a right channel at least, including: a surround signal generating process which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting process which sets the first gain and the second gain so that a correlation between the surround signal of the left channel and the surround signal of the right channel which are generated by the surround signal generating process realizes a correlation between surround signals of an actual content having a surround sound.

According to still another aspect of the present invention, there is provided a surround signal generating program executed by a computer, to which two-channel sound signals having a left channel and a right channel are inputted, and which generates surround signals of a left channel and a right channel at least, making the computer function as: a surround signal generating unit which subtracts a sound signal obtained by multiplying a first gain by the inputted sound signal of the right channel from the inputted sound signal of the left channel so as to generate the surround signal of the left channel, and which subtracts a sound signal obtained by multiplying a second gain by the inputted sound signal of the left channel from the inputted sound signal of the right channel so as to generate the surround signal of the right channel; and a gain setting unit which sets the first gain and the second gain so that a correlation between the surround signal of the left channel and the surround signal of the right channel which are generated by the surround signal generating unit realizes a correlation between surround signals of an actual content having a surround sound.

According to the surround signal generating method and the surround signal generating program, it becomes possible to appropriately generate the surround signals which can realize the correlation between the surround signals of the actual content, too.

EMBODIMENT

Preferred embodiments of the present invention will be explained hereinafter with reference to the drawings.

[Basic Concept]

First, a description will be given of a basic concept of a surround signal generating method according to an embodiment. Hereinafter, such an example that four-channel sound signals are generated from inputted two-channel sound signals will be given.

FIG. 1 is a diagram showing an example of a four-channel system. As shown in FIG. 1, a speaker 10 includes a front left speaker 10FL, a front right speaker 10FR, a rear left speaker 10SL and a rear right speaker 10SR. In this case, a listening position corresponds to a position shown by a reference numeral 70, for example.

In the specification, a channel of the front left speaker 10FL is referred to as "front left channel", and a channel of the front right speaker 10FR is referred to as "front right channel", and a channel of the rear left speaker 10SL is referred to as "rear left channel", and a channel of the rear right speaker 10SR is referred to as "rear right channel". The rear left channel and the rear right channel correspond to the surround channel, and a sound signal of the rear left channel and a sound signal of the rear right channel correspond to the surround signal.

Additionally, a combination of the front left channel and the front right channel is referred to as "front channel", and a combination of the rear left channel and the rear right channel is referred to as "rear channel". The rear channel corresponds to the above surround channel. Furthermore, a correlation between the sound signal of the rear left channel and the sound signal of the rear right channel (corresponding to a correlation between the surround channels) is referred to as "SL-SR correlation" (see an area 81 drawn by a broken line), and a correlation between the sound signal of the front channel and the sound signal of the rear channel is referred to as "F-B correlation" (see areas 82 drawn by a broken line).

Figure 2:
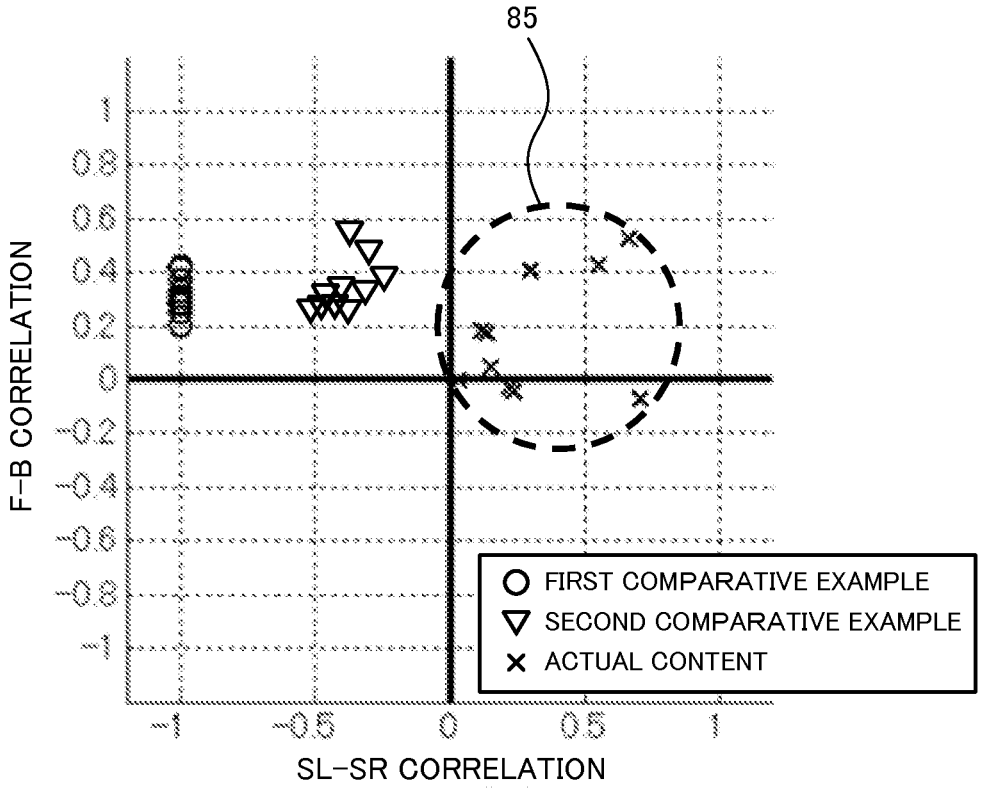
FIG. 2 is a diagram showing an example of correlations of each channel.

FIG. 2 is a diagram (scatter diagram) showing an example of correlations of each channel. In FIG. 2, a horizontal axis shows a SL-SR correlation, and a vertical axis shows a F-B correlation. FIG. 2 shows multiple SL-SR correlations and multiple F-B correlations of the surround signals which are obtained by methods of a first comparative example and a second comparative example, and shows multiple SL-SR correlations and multiple F-B correlations of the actual content having the surround sound. Concretely, FIG. 2 shows results of ten songs which are obtained by the first comparative example, the second comparative example and the actual content, as the scatter diagrams. For example, the results are obtained by a simulation. As an example, the actual content is a music content of a commercial DVD having a surround sound source of 5.1 channels.

The first comparative example and the second comparative example generate the surround signals of multiple channels from two-channel sound signals (stereo signals). Concretely, the first comparative example generates sound signals of the rear left channel and the rear right channel based on a difference between the inputted sound signal of the left channel and the inputted sound signal of the right channel. Specifically, the first comparative example substantially outputs a sound signal obtained by subtracting the inputted sound signal of the right channel from the inputted sound signal of the left channel, as the sound signal of the rear left channel, and the first comparative example substantially outputs a sound signal obtained by subtracting the inputted sound signal of the left channel from the inputted sound signal of the right channel, as the sound signal of the rear right channel. Meanwhile, the second comparative example corresponds to the above method described in Patent Reference-1. Concretely, the second comparative example generates the high correlation signal from the inputted sound signals and calculates the difference, so as to make the sound signals of the rear left channel and the rear right channel uncorrelated.

According to the first comparative example, it can be understood that the SL-SR correlation is an inverse correlation. According to the second comparative example, it can be understood that the SL-SR correlation is a decorrelation. In contrast, according to the actual content, it can be understood that SL-SR correlation is a positive correlation. Specifically, the SL-SR correlation of the actual content is substantially from "0" to "0.8" (see an area 85 drawn by a broken line). Therefore, by the first comparative example and the second comparative example, it is determined that the SL-SR correlation between the rear left channel and the rear right channel which are generated by the comparative examples does not appropriately realize the SL-SR correlation of the actual content.

Thus, the embodiment generates the surround signals which can realize the SL-SR correlation of the actual content. Namely, the embodiment generates the sound signals of the rear left channel and the rear right channel from the inputted two-channel sound signals so that the SL-SR correlation between the sound signal of the rear left channel and the sound signal of the rear right channel substantially coincides with the SL-SR correlation of the actual content (for example, so that the SL-SR correlation becomes at least the positive correlation). Additionally, the embodiment generates the surround signals which can realize not only the SL-SR correlation but also F-B correlation of the actual content.

Hereinafter, a description will be given of concrete embodiments according to the above surround signal generating method.

First Embodiment

At first, a description will be given of a first embodiment. The first embodiment calculates the sound signal of the rear left channel and the sound signal of the rear left channel from expressions (1) and (2).

$$SL=L-g1\cdot R \quad (1)$$

$$SR=R-g2\cdot L \quad (2)$$

In the expressions (1) and (2), "L" indicates the sound signal of the left channel in the inputted two-channel sound signals (stereo signals), and "R" indicates the sound signal of the right channel in the inputted two-channel sound signals (stereo signals). Additionally, "SL" indicates the sound signal (surround signal) of the rear left channel which is calculated by the expression (1), and "SR" indicates the sound signal (surround signal) of the rear right channel which is calculated by the expression (2). Furthermore, "g1" and "g2" indicate a gain. Concretely, the gain g1 indicates such a degree that the sound signal R of the right channel affects the sound signal L of the left channel when the sound signal SL of the rear left channel is calculated. Meanwhile, the gain g2 indicates such a degree that the sound signal L of the left channel affects the sound signal R of the right channel when the sound signal SR of the rear right channel is calculated. Basically, the gain g1 and the gain g2 are set to a value smaller than "1". The gain g1 and the gain g2 correspond to the first gain and the second gain in the present invention, respectively.

In addition, the first embodiment delays the sound signal SL of the rear left channel and the sound signal SR of the rear right channel. Concretely, the first embodiment delays the sound signal SL of the rear left channel and the sound signal SR of the rear right channel (these correspond to the sound signals of the rear channel) which are calculated by the expressions (1) and (2) with respect to the sound signals of the front channel, by a predetermined delay value (hereinafter referred to as "delay Δ"). For example, a unit of the delay Δ is represented by [ms]. Basically, the delay Δ is set to a value equal to or larger than "0".

Here, by adjusting the gain g1, the gain g2 and the delay Δ, the first embodiment generates the surround signals which can realize the correlation between the channels of the actual content (see FIG. 2). Concretely, the first embodiment determines the gain g1, the gain g2 and the delay Δ so that the SL-SR correlation between the rear left channel and the rear right channel satisfies the SL-SR correlation of the actual content, and so that the F-B correlation between the front channel and the rear channel satisfies the F-B correlation of the actual content. Then, the first embodiment generates the sound signal SL of the rear left channel and the sound signal SR of the rear right channel from the inputted sound signals L and R, by using the gain g1, the gain g2 and the delay Δ which are determined by the above method.

The sound signals which are generated by delaying the sound signals SL and SR calculated from the expressions (1) and (2) by "Δ" are represented by using the reference numerals "SL" and "SR", too.

Figure 3:
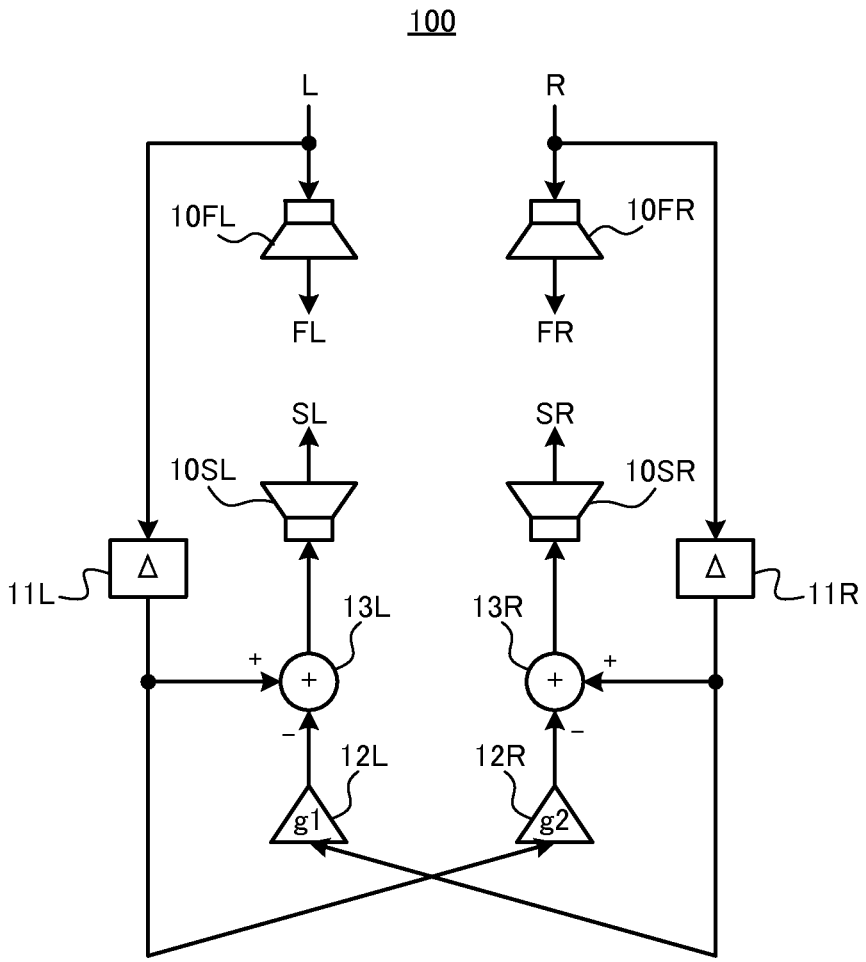
FIG. 3 is a block diagram showing a configuration of a surround signal generating device according to a first embodiment.

Next, a description will be given of an example of a configuration of the surround signal generating device according to the first embodiment, with reference to FIG. 3. FIG. 3 is a block diagram showing the configuration of the surround signal generating device 100 according to the first embodiment. The surround signal generating device 100 mainly includes a front left speaker 10FL, a front right speaker 10FR, a rear left speaker 10SL, a rear right speaker 10SR, delay processing units 11L and 11R, multipliers 12L and 12R, and adders 13L and 13R.

The surround signal generating device 100 is installed on an audio device, for example. The two-channel sound signals L and R are inputted to the surround signal generating device 100, and the surround signal generating device 100 generates the four-channel sound signals based on the sound signals L and R. Concretely, the surround signal generating device 100 generates the sound signals FL, FR, SL and SR which are outputted from the front left speaker 10FL, the front right speaker 10FR, the rear left speaker 10SL and the rear right speaker 10SR, respectively. In this case, the surround signal generating device 100 directly sets the sound signals L and R to the sound signals FL and FR (namely, "FL=L" and "FR=R"). In other words, the surround signal generating device 100 directly makes the front left speaker 10FL and the front right speaker 10FR output the inputted sound signals L and R, respectively.

Meanwhile, as for the sound signal SL outputted from the rear left speaker 10SL and the sound signal SR outputted from the rear right speaker 10SR, the surround signal generating device 100 generates these sound signals by using the delay processing units 11L and 11R, the multipliers 12L and 12R and the adders 13L and 13R. Concretely, the surround signal generating device 100 subtracts such a sound signal that the multiplier 12L multiplies the gain g1 by a sound signal for which the delay processing unit 11R delays the sound signal R by "Δ" from a sound signal for which the delay processing unit 11L delays the sound signal L by "Δ", so as to generate the sound signal SL outputted from the rear left speaker 10SL. Similarly, the surround signal generating device 100 subtracts such a sound signal that the multiplier 12R multiplies the gain g2 by a sound signal for which the delay processing unit 11L delays the sound signal L by "Δ" from a sound signal for which the delay processing unit 11R delays the sound signal R by "Δ", so as to generate the sound signal SR outputted from the rear right speaker 10SR. Thus, the delay processing units 11L and 11R, the multipliers 12L and 12R and the adders 13L and 13R correspond to an example of the surround signal generating unit in the present invention.

For the sake of convenience, FIG. 3 only shows a part of the components in the surround signal generating device 100. For example, the surround signal generating device 100 includes a control unit (such as CPU) and/or a storage unit (such as ROM, RAM and HDD) other than the components shown in FIG. 3. In this case, the control unit functions as the gain setting unit and the delay value setting unit in the present invention, and sets the gains g1 and g2 used by the multipliers 12L and 12R and the delay Δ used by the delay processing units 11L and 11R.

FIG. 3 shows such an example that the multipliers 12L and 12R and the adders 13L and 13R process the sound signals after being delayed by the delay processing units 11L and 11R. However, instead of this, the delay processing units 11L and 11R may delay the sound signals after being processed by the multipliers 12L and 12R and the adders 13L and 13R. Namely, as another example, a surround signal generating device can be formed to install the delay processing units 11L between the adder 13L and the rear left speaker 10SL, and to install the delay processing units 11R between the adder 13R and the rear right speaker 10SR. According to the example, the surround signal generating device subtracts a sound signal obtained by multiplying the gain g1 by the sound signal R from the sound signal L, and delays the sound signal obtained by the subtraction, by "Δ", so as to generate the sound signal SL. Additionally, the surround signal generating device subtracts a sound signal obtained by multiplying the gain g2 by the sound signal L from the sound signal R, and delays the sound signal obtained by the subtraction, by "Δ", so as to generate the sound signal SR.

Figure 4:
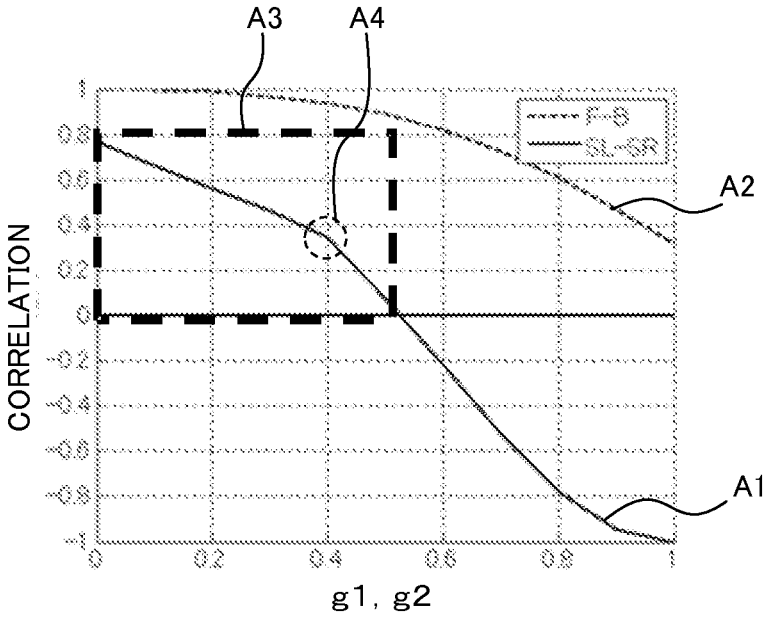
FIG. 4 is a diagram for concretely explaining step 1 according to a first embodiment.
Figure 5:
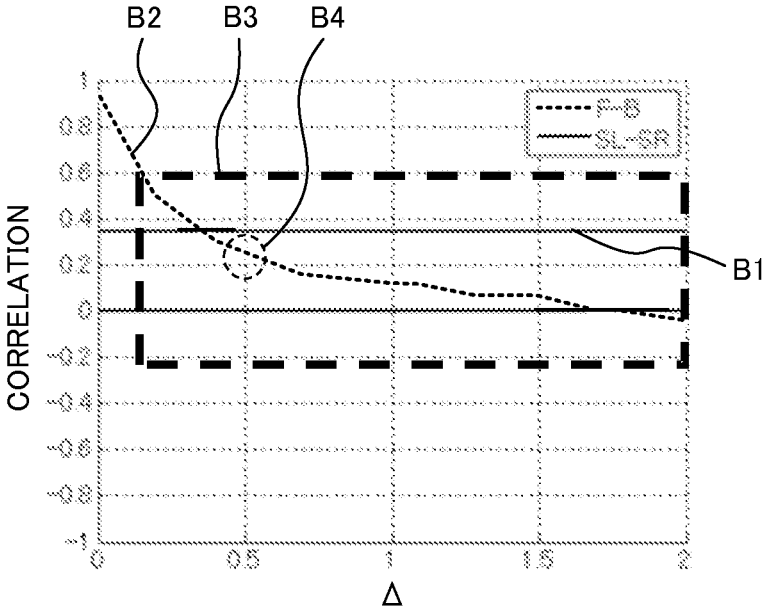
FIG. 5 is a diagram for concretely explaining step 2 according to a first embodiment.

Next, a description will be given of a method for determining the gain g1, the gain g2 and the delay Δ in the first embodiment, with reference to FIG. 4 and FIG. 5. For example, the above control unit in the surround signal generating device 100 determines the gain g1, the gain g2 and the delay Δ.

In the first embodiment, the gain g1 and the gain g2 are determined, and then the delay Δ is determined. Hereinafter, a step for determining the gain g1 and the gain g2 is referred to as "step 1", and a step for determining the delay Δ is referred to as "step 2".

In the step 1, the gains g1 and g2 are determined in order to realize the SL-SR correlation of the actual content. In the first embodiment, the gains g1 and g2 being the same value are determined. Concretely, in the step 1, based on the SL-SR correlation between the sound signal SL of the rear left channel and the sound signal SR of the rear right channel which is obtained when the values of the gains g1 and g2 are changed in such a situation that the value of the delay Δ is fixed, the gains g1 and g2 are determined in order to realize the SL-SR correlation of the actual content. As an example, the gains g1 and g2 are determined in order to obtain the SL-SR correlation which is within a range of SL-SR correlations calculated from multiple actual contents. As another example, the gains g1 and g2 are determined in order to obtain the SL-SR correlation which coincides with an average value of SL-SR correlations calculated from multiple actual contents.

Next, in the step 2, by using the gains g1 and g2 determined in the step 1, the delay Δ is determined in order to realize the F-B correlation of the actual content. Concretely, in the step S2, based on the F-B correlation between the front channel and the rear channel which is obtained when the value of the delay Δ is changed in such a situation that the gains g1 and g2 are fixed to the values determined in the step 1, the delay Δ is determined in order to realize the F-B correlation of the actual content. As an example, the delay Δ is determined in order to obtain the F-B correlation which is within a range of F-B correlations calculated from multiple actual contents. As another example, the delay Δ is determined in order to obtain the F-B correlation which coincides with an average value of F-B correlations calculated from multiple actual contents.

A description will be given of the step 1 in the first embodiment, with reference to FIG. 4. In FIG. 4, a horizontal axis shows the gains g1 and g2, and a vertical axis shows the correlation. It is assumed that the gains g1 and g2 are the same value.

Graphs A1 and A2 show an example of the SL-SR correlation between the sound signal SL of the rear left channel and the sound signal SR of the rear right channel and an example of the F-B correlation between the front channel and the rear channel, respectively, which are obtained when the values of the gains g1 and g2 are changed from "0" to "1" in such a situation that the delay Δ is fixed. Concretely, the graphs A1 and A2 show an average value of the SL-SR correlation and an average value of the F-B correlation, respectively, which are obtained when contents of three songs are used and the delay Δ is set to "0 [ms]" (namely, the surround signals SL and SR are not delayed). For example, the graphs A1 and A2 are obtained by a simulation. It is not limited that the delay Δ is set to "0 [ms]".

Here, as shown in FIG. 2, it can be understood that the SL-SR correlation of the actual content is substantially within a range from "0" to "0.8". The range (0<=SL-SR correlation<=0.8) is used as a condition which the SL-SR correlation should satisfy. Then, as shown by the graph A1 in FIG. 4, it can be understood that the said condition is satisfied when the gains g1 and g2 are substantially within a range from "0" to "0.5" (see an area A3 drawn by a broken line). In this case, an arbitrary value within the range from "0" to "0.5" is determined as the gains g1 and g2. Meanwhile, the average value of the SL-SR correlation of the actual content is used as a condition which the SL-SR correlation should satisfy. Then, if the average value of the SL-SR correlation is "0.34", for example, the said average value is obtained when the gains g1 and g2 are "0.4" (see an area A4 drawn by a broken line). In this case, "0.4" is determined as the gains g1 and g2.

On the other hand, as shown in FIG. 2, it can be understood that the F-B correlation of the actual content is substantially within a range from "−0.2" to "0.6". Next, as shown by the graph A2 in FIG. 4, it can be understood that the F-B correlation is not within the above range "−0.2" to "0.6". Namely, even if the gains g1 and g2 are changed, it is determined that the desired F-B correlation cannot be obtained. Therefore, in the latter step 2, the delay Δ is determined in order to obtain the desired F-B correlation, by using the gains g1 and g2 determined in the step 1.

Next, a description will be given of the step 2 in the first embodiment, with reference to FIG. 5. In FIG. 5, a horizontal axis shows the delay Δ, and a vertical axis shows the correlation.

Graphs B1 and B2 show an example of the SL-SR correlation between the sound signal SL of the rear left channel and the sound signal SR of the rear right channel and an example of the F-B correlation between the front channel and the rear channel, respectively, which are obtained when the delay Δ is changed from "0 [ms]" to "2 [ms]" in such a situation that the gains g1 and g2 are fixed to the value determined in the step 1. Concretely, the graphs B1 and B2 show an average value of the SL-SR correlation and an average value of the F-B correlation, respectively, which are obtained when the gains g1 and g2 are set to "0.4" and contents of three songs are used. For example, the graphs B1 and B2 are obtained by a simulation. In this case, as shown by the graph B1, since the gains g1 and g2 are fixed to "0.4" determined in the step 1, the SL-SR correlation is maintained at approximately "0.34". This is because, even if such a degree (Δ) that the rear channel is outputted behind the front channel is changed, the SL-SR correlation of the rear channel is not affected.

Here, the above range (−0.2<=F-B correlation<=0.6) is used as a condition which the F-B correlation should satisfy. Then, as shown by the graph B2 in FIG. 5, it can be understood that the said condition is satisfied when the delay Δ is substantially within a range from "0.2 [ms]" to "2.0 [ms]" (see an area B3 drawn by a broken line). In this case, an arbitrary value within the range from "0.2" to "2.0" is determined as the delay Δ. Meanwhile, the average value of the F-B correlation of the actual content is used as a condition which the F-B correlation should satisfy. Then, if the average value of the F-B correlation is "0.22", for example, the said average value is obtained when the delay Δ is "0.5 [ms]" (see an area B4 drawn by a broken line). In this case, "0.5 [ms]" is determined as the delay Δ.

By using the gains g1 and g2 determined in the step 1 and the delay Δ determined in the step 2, the surround signal generating device 100 generates the sound signal SL outputted from the rear left speaker 10SL and the sound signal SR outputted from the rear right speaker 10SR. Concretely, the surround signal generating device 100 sets the determined gains g1 and g2 to the multipliers 12L and 12R, and set the determined delay Δ to the delay processing units 11L and 11R, so as to generate the sound signals SL and SR (see FIG. 3). Therefore, it is possible to appropriately generate the surround signals which can realize both the SL-SR correlation and the F-B correlation of the actual content.

The surround signal generating device 100 may determine the gains g1 and g2 and the delay Δ, or other device (for example, PC) may preliminarily determine the gains g1 and g2 and the delay Δ instead of the surround signal generating device 100. When the surround signal generating device 100 determines the gains g1 and g2 and the delay Δ, the control unit in the surround signal generating device 100 can determine the gains g1 and g2 and the delay Δ. In this case, whenever the reproduced content is changed, the control unit can newly calculate the gains g1 and g2 and the delay Δ. Additionally, during reproducing the content, the control unit can repeatedly calculate the gains g1 and g2 and the delay Δ by updating the average value of the SL-SR correlation and the average value of the F-B correlation, so as to execute learning by the calculated gains g1 and g2 and delay Δ.

Meanwhile, when the above device other than the surround signal generating device 100 determines the gains g1 and g2 and the delay Δ, the said device can determine the gains g1 and g2 and the delay Δ by preliminarily executing the above step 1 and step 2. In this case, the gains g1 and g2 and the delay Δ determined by the said device are stored in the storage unit in the surround signal generating device 100 (for example, a database of the gains g1 and g2 and the delay Δ is made), and the surround signal generating device 100 reads the gains g1 and g2 and the delay Δ from the storage unit so as to generate the surround signals. The said storage unit corresponds to the storage unit in the present invention.

Second Embodiment

Next, a description will be given of a second embodiment. In the above first embodiment, the gains g1 and g2 being the same value are determined in the step 1. The second embodiment is different from the first embodiment in that the gains g1 and g2 having different values are determined in the step 1. Namely, it is not limited that the gains g1 and g2 are set to the same value. The gains g1 and g2 may be set to the different values. The second embodiment relates to a method for determining the gains g1 and g2 when the gains g1 and g2 are set to the different values.

In the second embodiment, the method for generating the sound signals SL and SR by using the gains g1 and g2 and the delay Δ, the configuration of the surround signal generating device 100 (see FIG. 3) and the method in the step 2 are the same as the first embodiment. Namely, the configuration and the method which are not particularly explained below are the same as the first embodiment.

Figure 6:
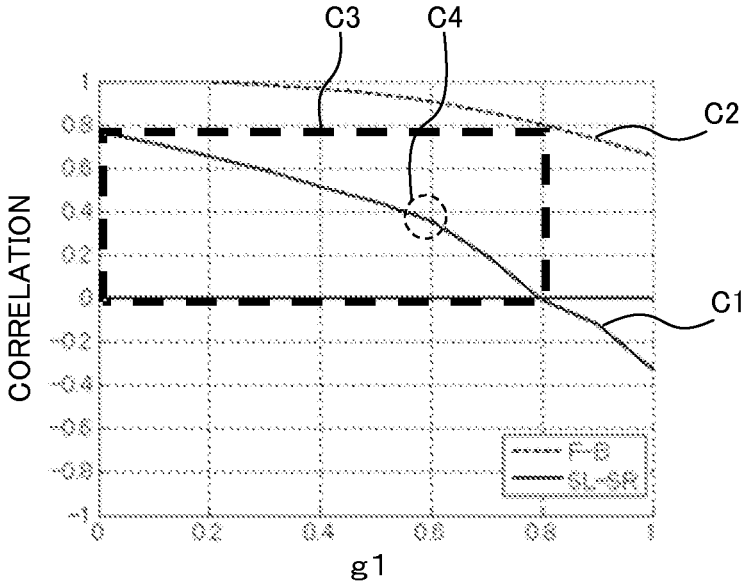
FIG. 6 is a diagram for concretely explaining step 1 according to a second embodiment.

A description will be given of the step 1 in the second embodiment, with reference to FIG. 6. In FIG. 6, a horizontal axis shows the gain g1, and a vertical axis shows the correlation. FIG. 6 shows such an example that the gain g2 is set to an arbitrary value smaller than "1" so as to determine the gain g1. For example, the gain g1 is determined by the above control unit in the surround signal generating device 100.

Graphs C1 and C2 show an example of the SL-SR correlation between the sound signal SL of the rear left channel and the sound signal SR of the rear right channel and an example of the F-B correlation between the front channel and the rear channel, respectively, which are obtained when the gain g1 is changed from "0" to "1" in such a situation that the gain g2 and the delay Δ are fixed. Concretely, the graphs C1 and C2 show an average value of the SL-SR correlation and an average value of the F-B correlation, respectively, which are obtained when the gain g2 is set to "0", and the delay Δ is set to "0 [ms]", and contents of three songs are used. For example, the graphs C1 and C2 are obtained by a simulation. It is not limited that the gain g2 is set to "0". In addition, it is not limited that the delay Δ is set to "0 [ms]".

Here, the above range (0<=SL-SR correlation<=0.8) is used as a condition which the SL-SR correlation should satisfy. Then, as shown by the graph C1 in FIG. 6, it can be understood that the said condition is satisfied when the gain g1 is substantially within a range from "0" to "0.8" (see an area C3 drawn by a broken line). In this case, an arbitrary value within the range from "0" to "0.8" is determined as the gain g1. Meanwhile, the average value of the SL-SR correlation of the actual content is used as a condition which the SL-SR correlation should satisfy. Then, if the average value of the SL-SR correlation is "0.34", for example, the said average value is obtained when the gain g1 is "0.6" (see an area C4 drawn by a broken line). In this case, "0.6" is determined as the gain g1. Then, by the same method as the first embodiment, the step 2 for determining the delay Δ is executed.

By using the gains g1 and g2 determined by the above method, it is possible to appropriately generate the surround signals which can realize both the SL-SR correlation and the F-B correlation of the actual content, too.

FIG. 6 shows such an example that the gain g1 which can realize the SL-SR correlation of the actual content exists when the gain g1 is changed in such a situation that the gain g2 is set to "0". However, if the gain g1 which can realize the SL-SR correlation of the actual content does not exist, the gain g1 may be determined in such a situation that the gain g2 is set to other values. Namely, until the gain g1 which can realize the SL-SR correlation of the actual content is obtained, the gain g2 may be changed to various values smaller than "1".

Additionally, FIG. 6 shows such an example that the gain g1 is determined in such a situation that the gain g2 is set to the arbitrary value. Instead of this, the gain g2 may be determined in such a situation that the gain g1 is set to the arbitrary value smaller than "1".

Effect of Embodiment

Next, a description will be given of an effect of the above embodiment, with reference to FIGS. 7A to 7C.

Figure 7A:
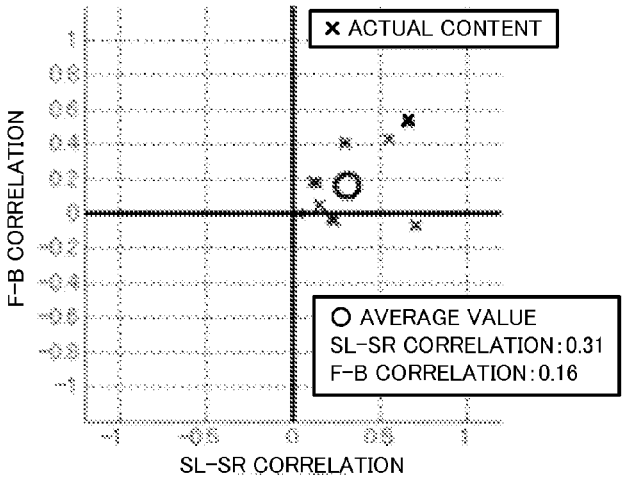
FIGS. 7A to 7C show diagrams for explaining an effect of an embodiment.
Figure 7B:
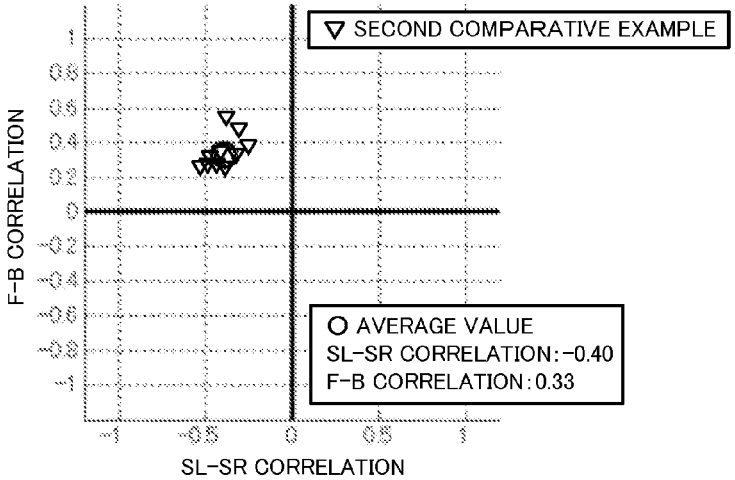
Figure 7C:
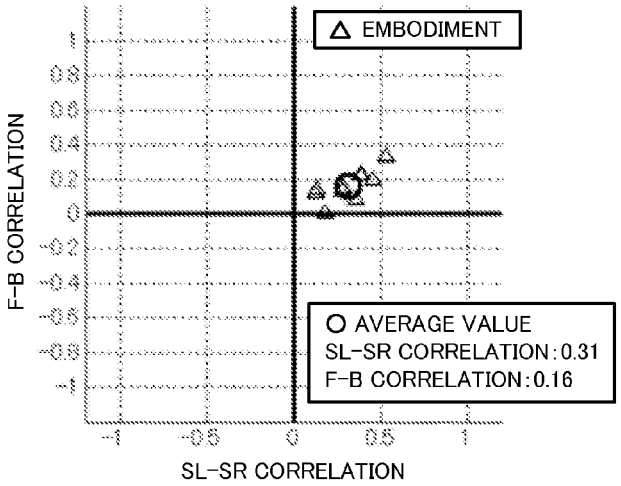

In FIGS. 7A to 7C, a horizontal axis shows the SL-SR correlation, and a vertical axis shows the F-B correlation. FIGS. 7A to 7C show examples of the correlation between the channels. Concretely, FIG. 7A shows multiple SL-SR correlations and multiple F-B correlations of the actual content, and FIG. 7B shows multiple SL-SR correlations and multiple F-B correlations of the surround signals which are obtained by the second comparative example, and FIG. 7C shows multiple SL-SR correlations and multiple F-B correlations of the surround signals which are obtained by the embodiment (concretely, first embodiment). Specifically, FIGS. 7A to 7C show results of ten songs which are obtained by the actual content, the second comparative example and the embodiment, as the scatter diagrams. For example, the results are obtained by a simulation. The result of the embodiment is obtained when the gains g1 and g2 are set to "0.37" and the delay Δ is set to "0.7 [ms]".

Additionally, in FIGS. 7A to 7C, the average values of the SL-SR correlation and the F-B correlation of the ten songs are represented by a circle. In the actual content, the average value of the SL-SR correlation is "0.31", and the average value of the F-B correlation is "0.16". In the second comparative example, the average value of the SL-SR correlation is "−0.40", and the average value of the F-B correlation is "0.33". In the embodiment, the average value of the SL-SR correlation is "0.31", and the average value of the F-B correlation is "0.16". Therefore, according to the embodiment, it can be understood that the SL-SR correlation and the F-B correlation of the actual content are appropriately realized.

[Modification]

Ii is not limited that the gains g1 and g2 and the delay Δ determined by the above method are consistently used. Namely, it is not limited that the gains g1 and g2 and the delay Δ are fixed to the values determined once. As another example, since the SL-SR correlation and the F-B correlation are changed when the content is changed, whenever the reproduced content is changed, graphs (see FIG. 4 and FIG. 5, for example) indicating relationships between the correlation and the gains g1 and g2 and the delay Δ are prepared so as to newly determine the gains g1 and g2 and the delay Δ. As still another example, the gains g1 and g2 and the delay Δ which should be set in accordance with a genre of content (for example, a popular music, a classic music, a jazz and a fusion) are preliminarily determined, and data (for example, table data) in which the gains g1 and g2 and the delay Δ are associated with the genre of content is stored in the storage unit in the surround signal generating unit 100. In the example, the surround signal generating unit 100 reads the gains g1 and g2 and the delay Δ in accordance with the genre of content from the storage unit so as to generate the surround signals. As still another example, the gains g1 and g2 and the delay Δ associated with the genre of content are stored in a server, and the surround signal generating unit 100 obtains the gains g1 and g2 and the delay Δ in accordance with the genre of content by communicating with the server.

Additionally, while the above embodiment shows such an example that the surround signals are generated so that both the SL-SR correlation and the F-B correlation of the actual content are realized, it is not limited to this. As another example, the surround signals may be generated so that only the SL-SR correlation of the actual content is realized. In the example, only the gains g1 and g2 are determined so that the SL-SR correlation of the actual content is realized. Namely, only the step 1 is executed (the step 2 is not executed). In this case, the delay Δ is set to a predetermined arbitrary value, or the delay Δ is not used (namely, the rear sound signals SL and SR are not delayed with respect to the front sound signals FL and FR).

Additionally, while the above embodiment shows such an example that the gains g1 and g2 are determined in order to obtain the SL-SR correlation which is within the range of SL-SR correlations calculated from multiple actual contents, or that the gains g1 and g2 are determined in order to obtain the SL-SR correlation which coincides with the average value of SL-SR correlations calculated from multiple actual contents, it is not limited to this. As another example, since the SL-SR correlation of the actual content is a positive correlation (see FIG. 2), the gains g1 and g2 may be determined so that the SL-SR correlation becomes at least the positive correlation.

Additionally, while the above embodiment shows such an example that the four-channel sound signals are generated from the inputted two-channel sound signals, it is not limited to this. The present invention can be applied to all devices which generate at least more than one surround signal from two-channel stereo signals, regardless of the number of generated channels. For example, the present invention can be applied to a device which uses five-channel sound signals having a center channel in addition to the above four-channel, or a device which uses sound signals of 5.1 channels having a channel used for a subwoofer in addition to the said 5-channel.

INDUSTRIAL APPLICABILITY

This invention can be applied to various audio devices.

DESCRIPTION OF REFERENCE NUMBERS

10FL Front Left Speaker
10FR Front Right Speaker
10SL Rear Left Speaker
10SR Rear Right Speaker
11L, 11R Delay Processing Unit
12L, 12R Multiplier
13L, 13R Adder
100 Surround Signal Generating Device

The invention claimed is:

1. A surround signal generating device, to which two-channel sound signals having a left channel and a right channel are inputted, and which generates surround signals of at least a left channel and a right channel, comprising:

a surround signal generating unit which subtracts a first sound signal, obtained by multiplying a first gain by an inputted sound signal of a right channel, from an inputted sound signal of a left channel so as to generate a surround signal of the left channel, and which subtracts a second sound signal, obtained by multiplying a second gain by the inputted sound signal of the left channel, from the inputted sound signal of the right channel so as to generate a surround signal of the right channel; and a gain setting unit which sets the first gain and the second gain so that a correlation between the surround signal of the left channel and the surround signal of the right channel which are generated by the surround signal generating unit is within a range of correlations between surround signals calculated from multiple actual contents, the multiple actual contents being content having a surround sound source of 5.1 channels, wherein the correlation between the surround signal of the left channel and the surround signal of the right channel is a positive correlation having a correlation value larger than zero.

2. The surround signal generating device according to claim 1, wherein the range of correlations between the surround signals is from a value greater than 0 to a value of 0.8.

3. The surround signal generating device according to claim 2, wherein the gain setting unit sets the first gain and the second gain to a same value.

4. The surround signal generating device according to claim 2, wherein the gain setting unit sets the first gain and the second gain to different values.

5. The surround signal generating device according to claim 1, wherein the gain setting unit sets the first gain and the second gain so that the correlation between the surround signal of the left channel and the surround signal of the right channel which are generated by the surround signal generating unit becomes an average value of correlations between surround signals which are calculated from the multiple actual contents.

6. The surround signal generating device according to claim 5, wherein the gain setting unit sets the first gain and the second gain to a same value.

7. The surround signal generating device according to claim 5, wherein the gain setting unit sets the first gain and the second gain to different values.

8. The surround signal generating device according to claim 1, wherein the gain setting unit sets the first gain and the second gain to a same value.

9. The surround signal generating device according to claim 1, wherein the gain setting unit sets the first gain and the second gain to different values.

10. The surround signal generating device according to claim 1, wherein the surround signal generating device generates sound signals of a front channel and sound signals of a rear channel, and uses the surround signals as the sound signals of the rear channel, wherein the surround signal generating device further includes a delay value setting unit which sets a delay value indicating time for outputting the sound signals of the rear channel behind the sound signals of the front channel, wherein the surround signal generating unit executes a process for outputting the surround signal of the left channel generated by using the first gain and the surround signal of the right channel generated by using the second gain behind the sound signals of the front channel, by the delay value set by the delay value setting unit, and wherein the delay value setting unit sets the delay value so that a correlation between the sound signals of the front channel and the sound signals of the rear channel including the surround signals of the left and right channels which are delayed by the surround signal generating unit realizes a correlation between sound signals of front and rear channels of the multiple actual contents.

11. The surround signal generating device according to claim 10, wherein the delay value setting unit sets the delay value so that the correlation between the sound signals of the front channel and the sound signals of the rear channel delayed by the surround signal generating unit is within a range of correlations between sound signals of front and rear channels, which are calculated from the multiple actual contents.

12. The surround signal generating device according to claim 11, wherein, whenever a content for which the surround signals are generated changes, the gain setting unit sets the first gain and the second gain, and the delay value setting unit sets the delay value.

13. The surround signal generating device according to claim 10, wherein the delay value setting unit sets the delay value so that the correlation between the sound signals of the front channel and the sound signals of the rear channel delayed by the surround signal generating unit becomes an average value of correlations between sound signals of front and rear channels, which are calculated from the multiple actual contents.

14. The surround signal generating device according to claim 13, wherein, whenever a content for which the surround signals are generated changes, the gain setting unit sets the first gain and the second gain, and the delay value setting unit sets the delay value.

15. The surround signal generating device according to claim 10, wherein, whenever a content for which the surround signals are generated changes, the gain setting unit sets the first gain and the second gain, and the delay value setting unit sets the delay value.

16. The surround signal generating device according to claim 10, further including a storage unit which stores the first gain, the second gain and the delay value which are preliminarily calculated, wherein the gain setting unit reads the first gain and the second gain from the storage unit, and sets the gains, and wherein the delay value setting unit reads the delay value from the storage unit, and sets the value.

17. The surround signal generating device according to claim 16, wherein the storage unit stores the first gain, the second gain and the delay value which are associated with each genre of contents, wherein the gain setting unit reads the first gain and the second gain in accordance with a genre of a content for which the surround signals are generated, from the storage unit, and wherein the delay value setting unit reads the delay value in accordance with the genre of the content for which the surround signals are generated, from the storage unit.

18. A surround signal generating method to which two-channel sound signals having a left channel and a right channel are inputted, and which generates surround signals of at least a left channel and a right channel, comprising:

a surround signal generating process which subtracts a first sound signal, obtained by multiplying a first gain by an inputted sound signal of a right channel, from an inputted sound signal of a left channel so as to generate a surround signal of the left channel, and which subtracts a second sound signal, obtained by multiplying a second gain by the inputted sound signal of the left channel, from the inputted sound signal of the right channel so as to generate a surround signal of the right channel; and a gain setting process which sets the first gain and the second gain so that a correlation between the surround signal of the left channel and the surround signal of the right channel which are generated by the surround signal generating process is within a range of correlations between surround signals which are calculated from multiple actual contents, the multiple actual contents being content having a surround sound source of 5.1 channels, wherein the correlation between the surround signal of the left channel and the surround signal of the right channel is a positive correlation having a correlation value larger than zero.

19. A surround signal generating computer program product stored in a non-transitory, tangible computer-readable medium readable by a computer, to which two-channel sound signals having a left channel and a right channel are inputted, the computer program product executable by a processing device of the computer for generating surround signals of at least a left channel and a right channel, the computer program product, upon execution by the processing device, causing the computer to function as:

a surround signal generating unit which subtracts a first sound signal, obtained by multiplying a first gain by an inputted sound signal of a right channel, from an inputted sound signal of a left channel so as to generate a surround signal of the left channel, and which subtracts a second sound signal, obtained by multiplying a second gain by the inputted sound signal of the left channel, from the inputted sound signal of the right channel so as to generate a surround signal of the right channel; and a gain setting unit which sets the first gain and the second gain so that a correlation between the surround signal of the left channel and the surround signal of the right channel which are generated by the surround signal generating unit is within a range of correlations between surround signals which are calculated from multiple actual contents, the multiple actual contents being content having a surround sound source of 5.1 channels, wherein the correlation between the surround signal of the left channel and the surround signal of the right channel is a positive correlation having a correlation value larger than zero.

* * * * *